US007793462B1

(12) United States Patent
Sherette

(10) Patent No.: US 7,793,462 B1
(45) Date of Patent: Sep. 14, 2010

(54) COMBINATION CEMETERY VASE AND FLAG HOLDER ADAPTER

(76) Inventor: Terry Sherette, 1529 Robin, Katy, TX (US) 77493

( * ) Notice: Subject to any disclaimer, the term of this patent is extended or adjusted under 35 U.S.C. 154(b) by 378 days.

(21) Appl. No.: 12/030,870

(22) Filed: Feb. 14, 2008

(51) Int. Cl.
*A47G 7/06* (2006.01)

(52) U.S. Cl. ..... 47/41.1; 428/34.1; 428/99; 116/173

(58) Field of Classification Search ..... 428/34.1, 428/99, 138; 47/41.1; 116/173
See application file for complete search history.

(56) References Cited

U.S. PATENT DOCUMENTS

| | | | |
|---|---|---|---|
| 2,148,660 | A | 2/1939 | Sweeney |
| 2,276,749 | A | 3/1942 | Vanderveer |
| 2,488,924 | A | 11/1949 | Meierjohan et al. |
| 2,754,625 | A | 7/1956 | Rasmussen |
| 3,052,065 | A | 9/1962 | Rettman |
| 3,229,948 | A | 1/1966 | King |
| 3,328,914 | A | 7/1967 | Newman |
| 3,434,235 | A | 3/1969 | Gordon et al. |
| 3,977,110 | A | 8/1976 | Yerger |
| 5,322,254 | A | 6/1994 | Birkmeier |
| 6,637,911 | B2 | 10/2003 | Sittner |

*Primary Examiner*—Alexander Thomas
(74) *Attorney, Agent, or Firm*—Kenneth A. Roddy

(57) ABSTRACT

A combination cemetery vase and flag holder adapter attaches to the mounting ring of an invertible type cemetery vase to hold the invertible vase in an upright or inverted position and has a laterally spaced smaller aperture for mounting a flagstaff and flag. The adapter has an elongate body with generally flat top and bottom surfaces, a larger aperture near a first end, and a smaller aperture near a second end. Depending lugs on the bottom surface surround the larger aperture and engage slots in the vase mounting ring secured to a gravestone surrounding an underground receptacle. Slots in the top surface and side wall of the larger aperture receive and detachably engage peripheral lugs on the base of the vase in an upright or inverted position. Slots in the top surface and side wall of the smaller aperture receive and detachably engage peripheral lugs of a collar at the bottom end of a flagstaff for supporting a flag a distance outwardly from the vase.

6 Claims, 5 Drawing Sheets

COMBINATION CEMETERY VASE AND FLAG HOLDER ADAPTER

BACKGROUND OF THE INVENTION

1. Field of the Invention

This invention relates generally to flower and flag displays in cemeteries, and more particularly, to a combination cemetery vase and flag holder adapter that attaches to the mounting ring of an invertible type cemetery vase and holds the invertible vase in an upright or inverted position and has a laterally spaced aperture for mounting the flagstaff of a flag.

2. Background Art

It is common practice to place wreaths, potted plants, cut flowers, and flags on and around graves and burial areas in remembrance of deceased persons. The prior art discloses various flower vases for use in cemeteries that can be inverted and stored in an underground receptacle or canister. These types of vases are known as "cemetery vases" or "memorial vases". A common invertible vase and storage structure of the prior art consists of a receptacle or canister that may be permanently installed in a hole in a gravestone and is surrounded at its top end by collar or mounting ring. The collar or mounting ring has a central aperture surrounded by a series of circumferentially spaced curved slots with an opening at one end. The cemetery vase has a circular base with a series of circumferentially spaced protruding lugs that are placed into the openings in the mounting ring the vase is rotated to engage the lugs into the curved slots of the mounting ring. The vase can be removed by reversing the procedure, and can be stored in the receptacle or canister with its open end facing down by inverting the vase and again inserting the protruding lugs into the openings in the mounting ring and rotating the vase to engage the lugs into the curved slots of the mounting ring.

Some examples of this type of structure are disclosed in the following U.S. patents: Vanderveer, U.S. Pat. No. 2,276,749, Meierjohna et al, U.S. Pat. No. 2,488,924, Rasmussen, U.S. Pat. No. 2,754,625, Rettman, U.S. Pat. No. 3,052,065, King, U.S. Pat. No. 3,229,948, Newman, U.S. Pat. No. 3,328,914, Gordon et al, U.S. Pat. No. 3,434,235, and Birkmeir, U.S. Pat. No. 5,322,254.

Another commercially available invertible cemetery vase of the type described above is known as the "Veteran Bronze Grecian Vase" manufactured by the Bronze Division of Matthews International Corporation of Pittsburgh, Pa.

Flags that are placed close to the gravestone are typically installed by merely pushing the flagstaff into the ground adjacent to the gravestone and are often blown over due to heavy wind and become inadvertently lost or not replaced by cemetery workers during grass cutting, excavation or other maintenance work.

Sweeney, U.S. Pat. No. 2,148,660 discloses a memorial tablet having a flag holder mounted on the rear for receiving a flag staff.

Yerger, U.S. Pat. No. 3,977,110 discloses a decorative grave marker comprising a one-piece molded rigid plastic assembly with an embossed decorative metalized legend on the front surface and four axially aligned bosses on the rear surface adapted for securely mounting the marker to a ground support rod and for support of a removable flagstaff.

Sittner, U.S. Pat. No. 6,637,911 discloses a grave marker and lighting apparatus having an interchangeable illuminated form which may in the form of a lighted candle, a lighted Christmas tree, a lighted floral arrangement, a lighted flag, or any other illuminated form to commemorate an occasion or season. The apparatus includes a base plate extension mounting portion for attachment to a tombstone and base extending anchors for ground securing.

SUMMARY OF THE INVENTION

The present invention is distinguished over the prior art in general, and these patents in particular by a combination cemetery vase and flag holder adapter that attaches to the mounting ring of an invertible type cemetery vase to hold the invertible vase in an upright or inverted position and has a laterally spaced aperture for receiving the flagstaff of a flag. The adapter has an elongate body with a generally flat top and bottom surface with depending lugs on the bottom surface surrounding a central aperture near a first end that engage slots in the vase mounting ring secured to a gravestone surrounding an underground receptacle, and has slots in the top surface surrounding the aperture that receive and engage peripheral lugs on the base of the vase in an upright or inverted position. The adapter is rotated relative to the mounting ring secure it to the ring and the vase is rotated relative to the adapter to secure it to the adapter. The flagstaff receiving aperture is disposed a distance outwardly from the central aperture near a second end of the adapter body and has slots in the top surface surrounding the aperture that receive and engage peripheral lugs of a collar member secured to the flagstaff of a flag for supporting a flag in an upright position.

One of the features and advantages of the combination cemetery vase and flag holder adapter is that it allows a flag to be supported adjacent to a cemetery vase containing plants or flowers.

Another feature and advantage of the combination cemetery vase and flag holder adapter is that it can be easily installed on preexisting cemetery vase mounting rings that may be secured to a gravestone surrounding an underground receptacle or canister that may be permanently installed in a hole in the gravestone, without requiring modification, removal or replacement of the preexisting members.

A further feature and advantage of the combination cemetery vase and flag holder adapter is that it allows a flag to be supported on or closely adjacent to the gravestone and in close proximity to a cemetery vase containing plants or flowers and reduces the chances of the flag being blown over due to wind and of inadvertently becoming lost or not being replaced by cemetery workers which may occur during grass cutting, excavation or other maintenance work.

Other features and advantages of the present invention will become apparent from time to time throughout the specification and claims as hereinafter related.

DESCRIPTION OF THE PREFERRED EMBODIMENT

Figure 6:
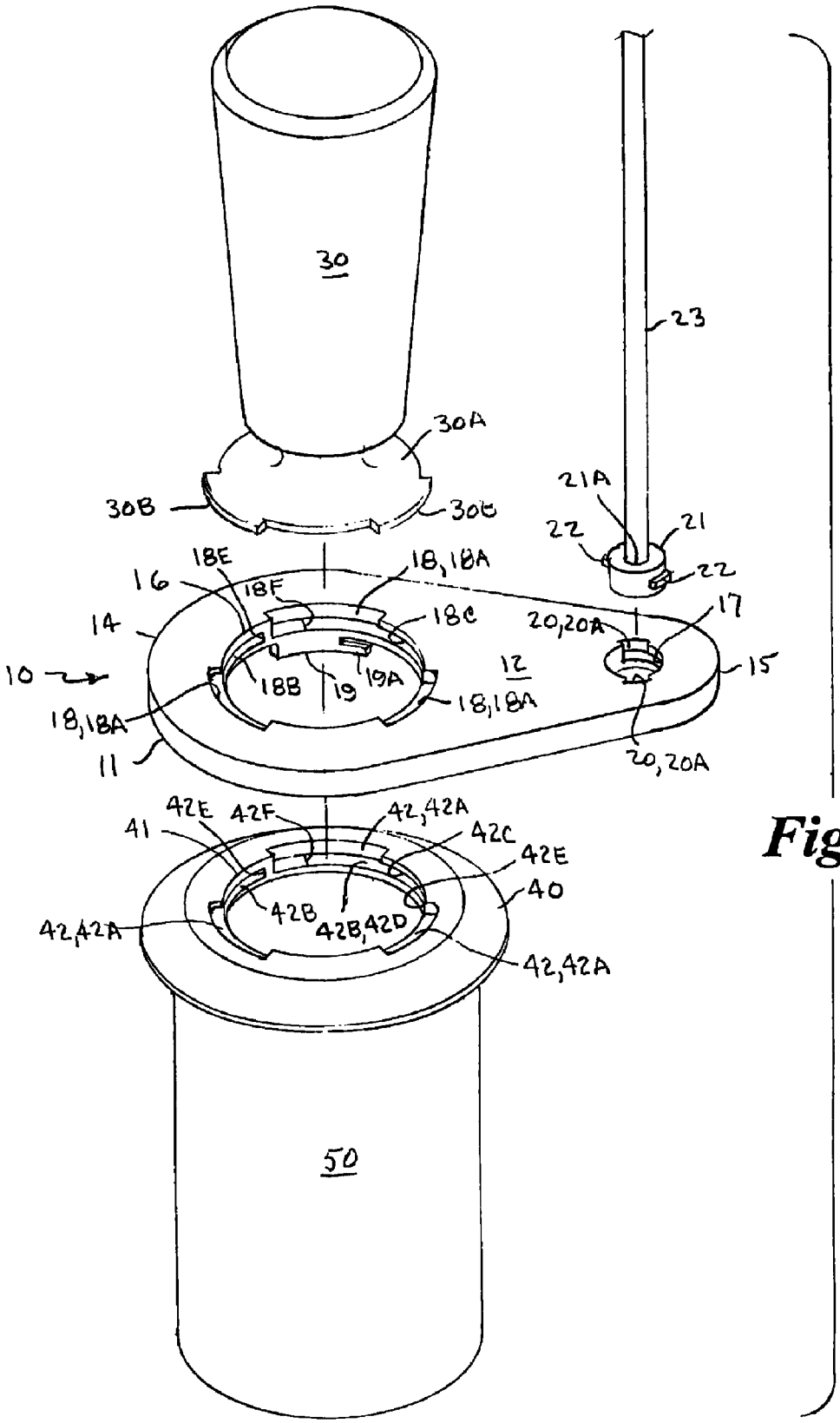
FIG. 6 is an exploded isometric view of the combination cemetery vase and flag holder adapter, shown interposed between the mounting ring and receptacle and the base portion of the invertible cemetery vase.
Figure 7:
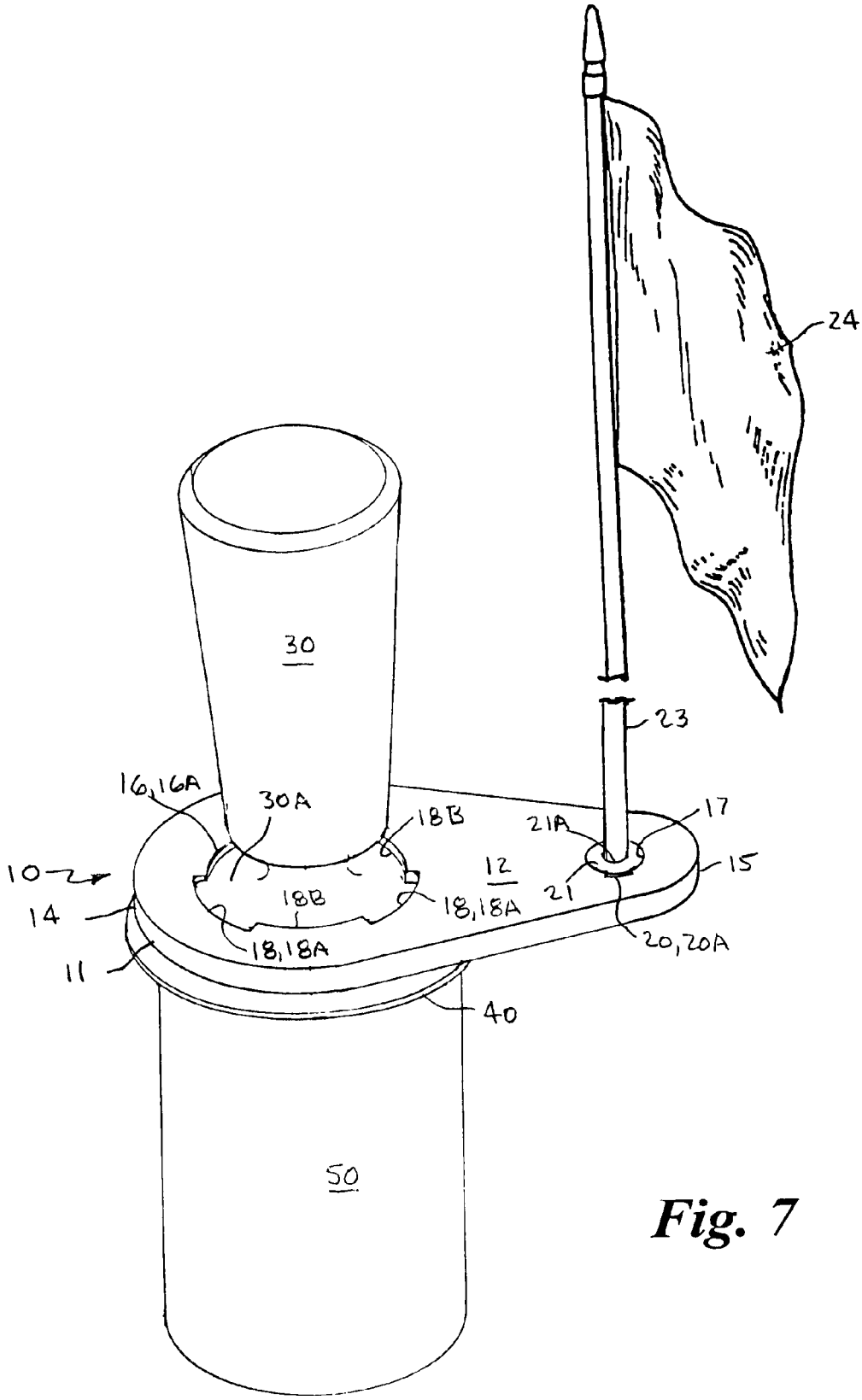
FIG. 7 is an isometric view showing the combination cemetery vase and flag holder adapter installed in the vase mounting ring, the base portion of the invertible cemetery vase installed in the adapter in an upright position, and the collar and flagstaff installed in the smaller hole with a flag at the upper end of the flagstaff.
Figure 8:
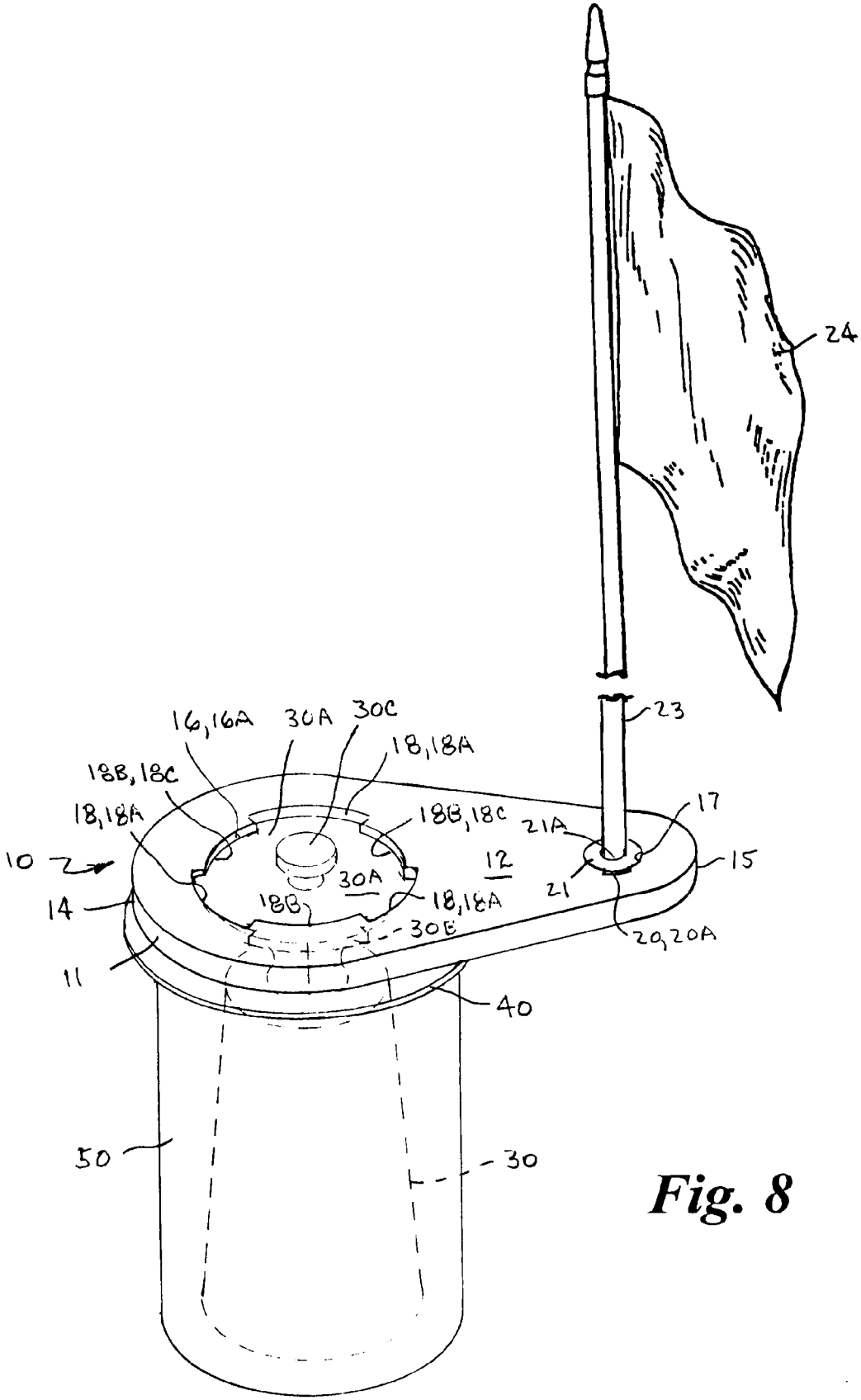
FIG. 8 is an isometric view showing the combination cemetery vase and flag holder adapter installed in the vase mounting ring, the base portion of the invertible cemetery vase installed in the adapter with the vase in an inverted position inside the receptacle, and the collar and flagstaff installed in the smaller hole with a flag at the upper end of the flagstaff.

Referring to the drawings by numerals of reference, there is shown in FIGS. 1 through 5, a combination cemetery vase and flag holder adapter 10 in accordance with the present invention. FIG. 6 shows the adapter 10 interposed between the base portion 30A of a conventional invertible cemetery vase 30 and the vase mounting ring 40. FIGS. 7 and 8 show the components in an assembled condition, with the vase 30 in an upright position and an inverted stored position, respectively. The conventional mounting ring 40 and cemetery vase 30 depicted in the drawings, for purposes of example only and not limited thereto, is similar to the vase and holder arrangement of the type shown and described in U.S. Pat. No. 3,434,235, which is hereby incorporated herein by reference in its entirety. It should be understood that the present combination cemetery vase and flag holder adapter may be configured for interconnection between the mounting ring and base portion of other conventional cemetery vases and mounting rings of the type having other configurations.

The conventional cemetery vase 30 has an elongate cup-shaped upper portion with an open top end and an enclosed bottom end defining an interior for holding cut flowers and a lower portion that terminates in a base 30A which is circular in plan view and has a plurality of circumferentially spaced, outwardly extending peripheral locking lugs 30B around its outer perimeter which have arcuate outer ends. Preferably, there are three outwardly extending locking lugs 30B, circumferentially spaced at 120° intervals around the perimeter of the base 30A.

As best seen in FIG. 6, the conventional mounting ring 40 is used for mounting flower or ground vases in a metal memorial plate installed on the gravestone or directly on the gravestone. The conventional mounting ring 40 has a circular opening surrounding the open top end of a hollow cylindrical receptacle 50. The conventional receptacle 50 is usually plastic and is located in the ground with its open top end and mounting ring positioned at, or slightly above, ground level.

The side wall 41 of the circular opening of the mounting ring 40 is formed with a series of countersunk generally L-shaped arcuate slot 42 having a vertical portion 42A extending downwardly from the top surface of the ring and an adjoining arcuate horizontal portion 42B extending in one direction (clockwise) a distance from the vertical portion defining a vertically spaced upper lip 42C and lower ledge 42D terminating at a vertical stop surface 42E. A short distance clockwise from its starting point, the arcuate horizontal lower ledge 42D drops down to form a short vertical shoulder 42F. Preferably, there are three such slots circumferentially spaced at 120° intervals around the side wall 41 of the central opening. In some conventional mounting rings, the end portion of the arcuate horizontal portion of the slot is curved about a different radius so as to gradually curve inwardly toward the center of the central opening, to facilitate casting and make the slot self-cleaning.

In the conventional mounting arrangement of the prior art, the peripheral locking lugs 30B of the base 30A of the vase 30 are normally received and engaged with the slots 42 of the mounting ring 40. However, in the present mounting arrangement, the adapter 10 in accordance with the present invention is received and engaged with the slots 42 of the mounting ring 40 and the peripheral locking lugs 30B on the base 30A of the invertible vase 30 are received and engaged with slots 18 in the adapter, as described in detail hereinafter.

As best seen in FIGS. 1-5, the adapter 10 has plate-like main body 11 with a generally flat top surface 12, a generally flat bottom surface 13, a first end 14 and a second end 15, a larger hole 16 having a side wall 16A extending through the body near the first end, and a smaller hole 17 extending therethrough near the second end which is spaced a distance outwardly from the larger hole. It the illustrated example, the first end 14 and second end 15 are curved and disposed in laterally opposed relation and the opposed longitudinal sides of the main body 11 extending between the curved ends are tapered inwardly from the first end to the second end. However, it should be understood that the main body 11 may have a different configuration.

Figure 1:
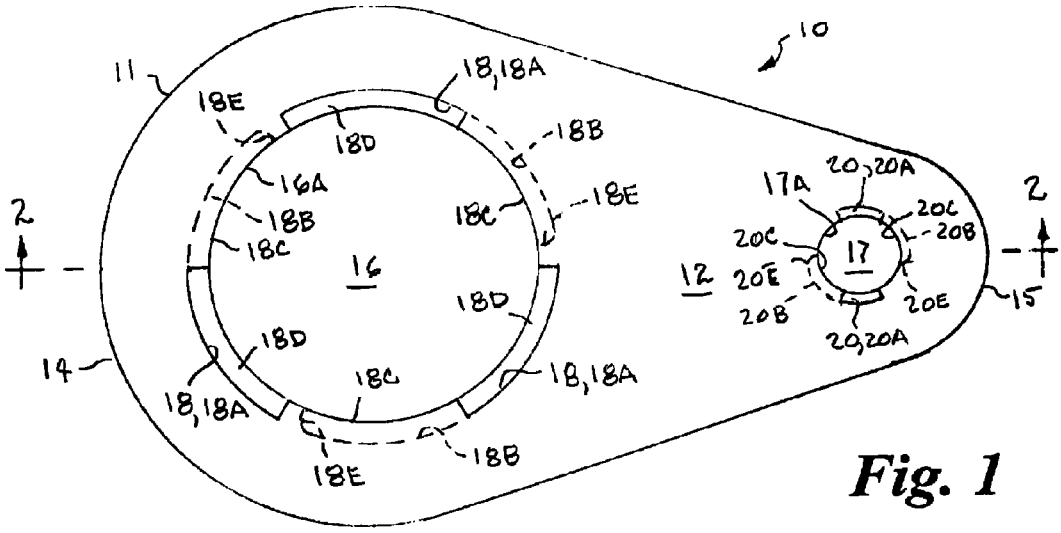
FIG. 1 is a top plan view of the combination cemetery vase and flag holder adapter in accordance with the present invention, showing the slot arrangement in the top surface and side wall of the larger hole and smaller hole.
Figure 2:
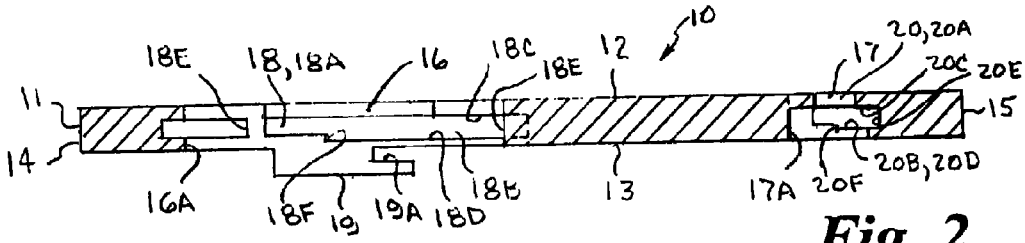
FIG. 2 is a cross sectional view taken along lines 2-2 of FIG. 1, showing the slot arrangement in the top surface and side wall of the larger hole and smaller hole.
Figure 3:
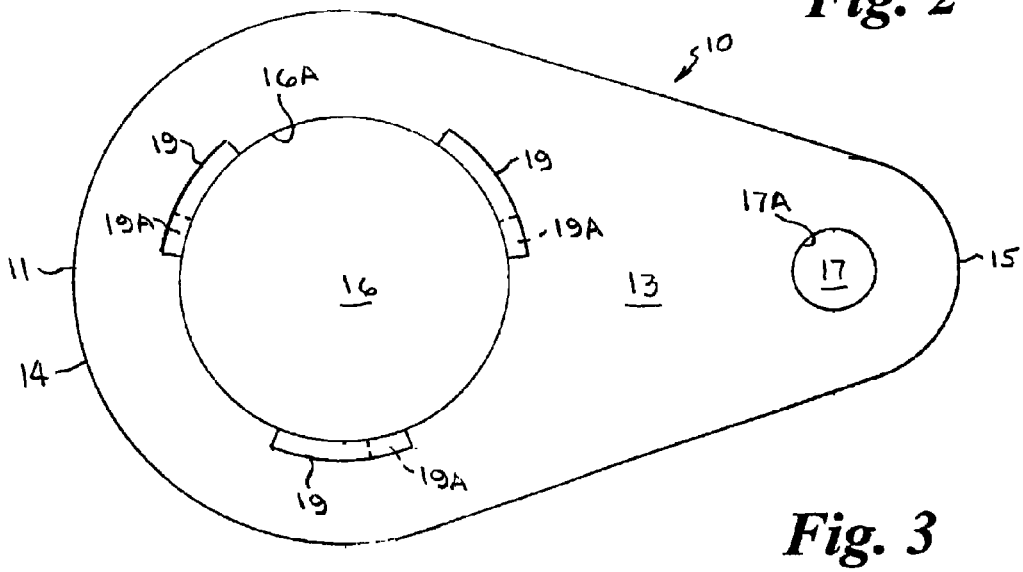
FIG. 3 is a bottom plan view of the bottom of the combination cemetery vase and flag holder adapter, showing the lug arrangement surrounding the larger hole.
Figure 4:
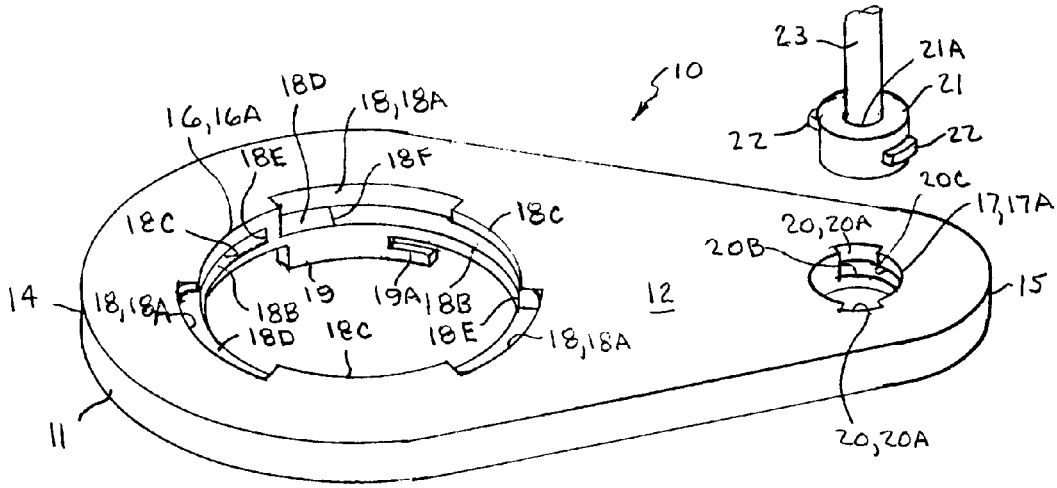
FIG. 4 is an isometric view of the combination cemetery vase and flag holder adapter as seen from the top, more clearly showing the slot arrangement in the top surface and side wall of the larger hole and smaller hole, and a collar and flagstaff spaced a distance above the smaller hole.
Figure 5:
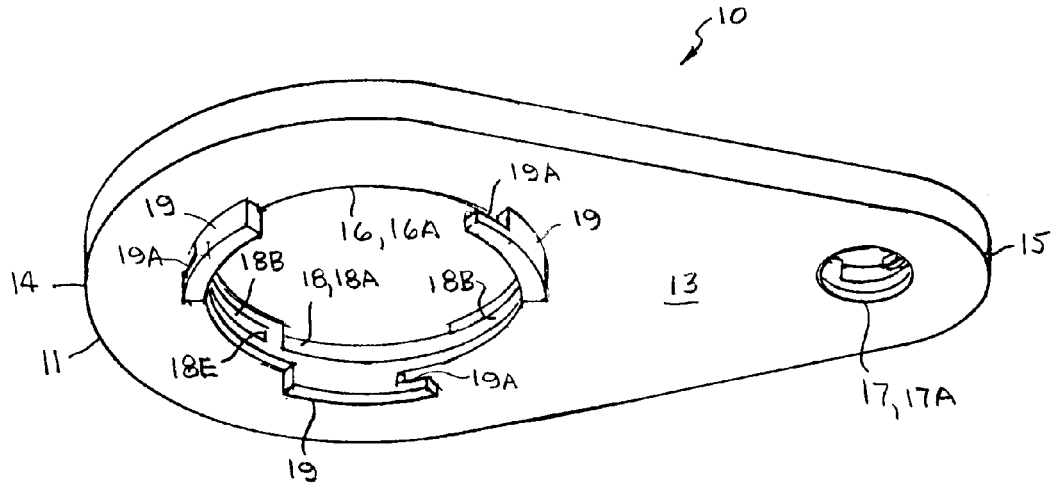
FIG. 5 is an isometric view of the combination cemetery vase and flag holder adapter as seen from the bottom, more clearly showing the showing the lug arrangement surrounding the larger hole.

In the same fashion of the mounting ring 40, the side wall 16A of the larger hole 16 of the adapter body 11 is formed with a countersunk generally L-shaped arcuate slot 18 having a vertical portion 18A extending downwardly from the top surface 12 of the adapter body and an adjoining arcuate horizontal portion 18B extending in one direction (clockwise) a distance from the vertical portion defining a vertically spaced upper lip 18C and lower ledge 18D terminating at a vertical stop surface 18E (FIGS. 1 and 2). A short distance clockwise from its starting point, the arcuate horizontal lower ledge 18D drops down to form a short vertical shoulder 18F. Preferably, there are three such slots circumferentially spaced at 120° intervals around the side wall 16A of the larger hole 16.

A set of arcuate generally L-shaped locking lugs 19 depend vertically from the bottom surface 13 of the adapter body 11 in circumferentially spaced relation surrounding the larger hole 16 for detachable engagement in the slots 42 in the side wall 41 of the mounting ring 40. Each arcuate locking lug 19 has a narrow vertical portion extending downwardly from the top surface of the ring and an adjoining arcuate horizontal portion 19A extending in one direction (clockwise) a distance beneath the bottom surface 13 of the adapter body 11. Preferably, there are three such arcuate lugs circumferentially spaced at 120° intervals around the side wall 16A of the larger hole 16 and they are centered beneath the vertical portion 18A of the slots 18 that extend downwardly from the top surface 12 of the adapter body 11. The length of the horizontal portion 19B is slightly less than the width of the downwardly extending vertical portion 42A of the slot 42 in the mounting ring 40.

The side wall 17A of the smaller hole 17 at the second end 15 of the adapter body 11 is formed with a countersunk generally L-shaped arcuate slot 20 having a vertical portion 20A extending downwardly from the top surface 12 of the adapter body and an adjoining arcuate horizontal portion 20B extending in one direction (clockwise) a distance from the vertical portion defining a vertically spaced upper lip 10C and lower ledge 20D terminating at a vertical stop surface 20E. A short distance clockwise from its starting point, the arcuate horizontal lower ledge 20D drops down to form a short vertical shoulder 20F. Preferably, there are two such slots circumferentially spaced 180° apart around the side wall 17A of the smaller hole 17.

A flagstaff collar 21 is provided which has a central bore 21A for engaging a flagstaff 23 having a flag 24 supported at its upper end, and a pair of arcuate locking lugs 22 extending radially outwardly from the circumference of the collar in diametrically opposed relation for detachable engagement in the slots 20 in the side wall of the smaller hole 17. The circumferential length of the locking lugs 22 is slightly less than the width of the downwardly extending vertical portion 20A of the slot in the side wall 17A of the smaller hole 17. The collar 21 may be secured to the bottom end of the flagstaff 23 by conventional means, such as glue, epoxy, adhesive, mechanical fasteners, frictional engagement, etc.

The adapter 10 is installed by holding it above the mounting ring 40, aligning the vertically depending arcuate L-shaped locking lugs 19 on its bottom surface 12 above the vertical portion 42A of the slots 42 in the mounting ring 40, lowering it downward such that the depending arcuate locking lugs 19 are received in the vertical portion 42A of the of the slots in the mounting ring and supported on the lower ledge 42D of the slots in the mounting ring. Then, the adapter 10 is rotated clockwise relative to the mounting ring 40 such that the horizontal portions 19A of the locking lugs 19 are engaged between the upper lip 42C and the lower ledge 42D of the slots 42 in the mounting ring. As the adapter 10 is rotated, the trailing end of the lugs 19 pass over the short vertical shoulder 42F and drop down such that the shoulder prevents the lugs from accidentally rotating counterclockwise and backing out.

The cemetery vase 30 is then installed in an upright position by holding it above the larger hole 16 of the adapter 10, aligning the outwardly extending peripheral locking lugs 30B of its base 30A above the vertical portion 18A of the slots 18 in the top of the adapter, lowering it downward such that the peripheral locking lugs 30B are received in the vertical portion 18A of the of the slots 18 in the adapter and supported on the lower ledge 18D of the slots in the adapter. Then, the vase 30 is rotated clockwise relative to the adapter 10 such that the peripheral locking lugs 30B are engaged between the upper lip 18C and the lower ledge 18D of the slots in the adapter. As the vase 30 is rotated, the trailing end of the lugs 30B pass over the short vertical shoulder 18F and drop down such that the shoulder prevents the lugs from accidentally rotating counterclockwise and backing out The flagstaff 23 is installed in the smaller hole 17 by holding the collar 21 at its bottom end above the smaller hole, aligning the arcuate locking lugs 22 of the collar above the vertical portion 20A of the slots 20 in the smaller hole, lowering it downward such that the arcuate locking lugs 22 are received in the vertical portion of the of the slots and supported on the lower ledge 20D of the slots. Then, the collar 21 is rotated clockwise relative to the smaller hole 17 such that the horizontal portions of the locking lugs are engaged between the upper lip 20C and the lower ledge 20D of the slots. As the collar 21 is rotated, the trailing end of the lugs 22 pass over the short vertical shoulder 20F and drop down such that the shoulder prevents the lugs from accidentally rotating counterclockwise and backing out.

The flag 24 may be secured to the upper end of the flagstaff 23 before or after the collar 21 has been installed on its bottom end, or before or after the collar has been engaged in the smaller hole 17 of the adapter 10. Thus when installed, the vase 30, and the flagstaff 23 and flag 24 are supported on the adapter 10 closely adjacent to the gravestone or memorial plaque.

The cemetery vase 30 and the flagstaff 23 and flag 24 can be easily removed as needed by rotating them such that the peripheral lugs 30B of the base 30A and lugs 22 of the collar 22 are aligned with the vertical portion 18A of the slots 18 in the adapter 10 and the vertical portion 20A of the slots of the smaller hole 17, respectively, and lifting them out of the adapter.

As seen in FIG. 8, the cemetery vase 30 can also be stored inside the receptacle 50 by removing it from the adapter 10, inverting it 180°, placing its open end downwardly through the larger hole 16 of the adapter, and then rotating it to engage the peripheral lugs 30B of its base 30A in the slots 18 of the adapter as described above. In the inverted position, the base 30A of the vase 30 encloses the larger hole 16 of the adapter 10.

The underside of the cylindrical base 30A of the conventional cemetery vase 30 may be provided with a depending knob 30C to facilitate gripping by the user and rotating or twisting the vase to engage or disengage the peripheral locking lugs 30B of the base in the slots 18 of the adapter 10.

The adapter 10 may be formed of any suitable rigid material, for example ornamental metal such as bronze or the like, and the top surface may be decorated or have indicia printed or engraved thereon identifying the deceased person and/or epitaphs, remembrances memorializing persons or events in the fashion of a memorial plaque. A length of chain may also be attached at one end to the adapter 10 and at the other end to the memorial plate or gravestone or to the mounting ring 40 so as to prevent unwanted removal or to deter theft from the gravesite.

While this invention has been described fully and completely with special emphasis upon preferred embodiments it should be understood and appreciated by those skilled in the art that various modifications and alternatives to the details described herein could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A combination cemetery vase and flag holder adapter for connection between a vase mounting ring at the top of a receptacle and the base of a conventional invertible cemetery vase, the ring having a central aperture with surrounding slots in its side wall and the base having peripheral lugs, said adapter comprising:

an adapter plate having a main body with a generally flat top surface, a generally flat bottom surface, a first end and a second end, a larger hole having a side wall extending through said plate near said first end for receiving the base of the vase, and a smaller hole having a side wall extending therethrough near said second end spaced a distance from said larger hole for mounting a flagstaff;

a set of lugs depending vertically from said bottom surface surrounding said larger hole for detachable engagement in the slots in the side wall of the mounting ring; and a set of slots in said top surface and side wall of said larger hole for receiving and detachably engaging the peripheral lugs of the base of the cemetery vase to support the vase in an upright position above the receptacle or an inverted stored position in the receptacle.

2. The combination cemetery vase and flag holder adapter according to claim 1, further comprising:

a generally cylindrical flagstaff collar having a set lugs extending radially outwardly from its circumference;

a set of slots in said top surface and side wall of said smaller hole for receiving and detachably engaging said lugs of said collar; and a flagstaff connected with said collar having a flag supported at its upper end.

3. The combination cemetery vase and flag holder adapter according to claim 1, wherein said adapter plate main body includes decorative indicia or ornamentation on said top surface.

4. The combination cemetery vase and flag holder according to claim 1, wherein said plate member main body includes decorative indicia or ornamentation on said top surface.

5. A combination cemetery vase and flag holder, comprising:

a receptacle having an open top end, and a mounting ring at said open top end, said mounting ring having a top wall, a central aperture having a side wall and a set of slots in said top wall and side wall surrounding said central aperture;

a plate member having a main body with a generally flat top surface, a generally flat bottom surface, a first end and a second end, a larger hole having a side wall extending through said plate near said first end in axial alignment with said mounting ring central aperture, and a smaller hole having a side wall extending therethrough near said second end spaced a distance from said larger hole for mounting a flagstaff for receiving the base of the vase, a set of lugs depending vertically from said bottom surface surrounding said larger hole for detachable engagement in said slots in said mounting ring, and a set of slots in said top surface and side wall of said larger hole; and a cemetery vase having an open top end and a base at a bottom end, said base having peripheral lugs for detachable engagement in said slots in said plate member larger hole to selectively support said vase on said plate member in either of an upright position above the receptacle or an inverted stored position in the receptacle.

6. The combination cemetery vase and flag holder according to claim 5, further comprising:

a generally cylindrical flagstaff collar having a set lugs extending radially outwardly from its circumference;

a set of slots in said plate member top surface and side wall of said smaller hole for receiving and detachably engaging said lugs of said collar; and a flagstaff connected with said collar having a flag supported at its upper end.

* * * * *